US005489121A

United States Patent [19]

Mohr

[11] Patent Number: 5,489,121

[45] Date of Patent: Feb. 6, 1996

[54] DEVICE FOR SECURING LOOSELEAF PAGES ON A GOLF CART STEERING COLUMN

[76] Inventor: Christopher G. Mohr, Rte. 1, Norwood, Ga. 30821

[21] Appl. No.: 304,590

[22] Filed: Sep. 12, 1994

Related U.S. Application Data

[63] Continuation-in-part of Ser. No. 125,419, Sep. 22, 1993, Pat. No. 5,387,010.

[51] Int. Cl.[6] ..... B42D 17/00

[52] U.S. Cl. ..... 281/43; 281/45; 281/51; 40/593; 248/447.2; 108/44; 280/DIG. 5; 224/274; 224/277; 402/4

[58] Field of Search ..... 281/34, 45, 51; 402/4; 40/593, 642, 530; D34/5, 15; 248/444, 447.1, 447.2; 108/44, 45, 46, 143; 280/DIG. 6, DIG. 5, 645, 33.992; 224/277, 274

[56] References Cited

U.S. PATENT DOCUMENTS

| | | | |
|---|---|---|---|
| D. 176,627 | 1/1956 | Nash . | |
| 1,573,447 | 2/1926 | Prewitt . | |
| 1,629,291 | 5/1927 | Muscate . | |
| 1,680,998 | 8/1928 | Krantz | 224/276 X |
| 1,733,293 | 10/1929 | Brow . | |
| 1,768,266 | 6/1930 | Connell | 224/276 X |
| 1,865,241 | 6/1932 | Dock | 224/276 X |
| 1,883,647 | 10/1932 | Ellison | 402/70 |
| 2,142,849 | 12/1938 | Baer . | |
| 2,201,789 | 5/1940 | Robilotto . | |
| 2,523,590 | 9/1950 | Potter et al. . | |
| 2,782,971 | 2/1957 | Hershey . | |
| 2,918,202 | 12/1959 | Constantine et al. . | |
| 3,128,021 | 4/1964 | Habbena . | |
| 3,311,276 | 3/1967 | Fromm . | |
| 4,034,539 | 7/1977 | Economy . | |
| 4,157,152 | 6/1979 | Blastic . | |
| 4,577,788 | 3/1986 | Richardson . | |
| 4,995,637 | 2/1991 | Muraishi . | |
| 5,072,957 | 12/1991 | Graebe . | |
| 5,083,736 | 1/1992 | McCoy . | |
| 5,086,960 | 2/1992 | Schwietzer . | |

*Primary Examiner*—Frances Han
*Attorney, Agent, or Firm*—Arthur A. Gardner

[57] ABSTRACT

A device for mounting to the steering column of a golf cart for supporting and displaying looseleaf pages, in particular for displaying golf course information. The device includes a base for supporting pages generally perpendicular to the cart's steering column. A binder is secured to the base for holding the looseleaf pages and an attachment element is provided for mounting the device to the steering column of the golf cart.

8 Claims, 4 Drawing Sheets

DEVICE FOR SECURING LOOSELEAF PAGES ON A GOLF CART STEERING COLUMN

This is a continuation-in-part of application(s) Ser. No. 08/125,419 filed on Sep. 22, 1993, now U.S. Pat. No. 5,387,010.

BACKGROUND OF THE INVENTION

In playing golf it can be quite helpful to know as much information about the hole to be played as possible. For example, it is helpful to know whether the hole involves water or other hazards which cannot be seen from the tee. Also, because the green is not always visible from the tee, it is often not readily apparent whether the green is situated to the left or to the right of a fairway when standing on the tee. Furthermore, if there is a "dogleg", it can be helpful to know what the distance is to the dogleg in order to play with the appropriate club in order to drive the ball the correct distance in setting up the next shot. Thus, course information can be a great help to the golfer on the course.

Heretofore, it has been common to employ aids on golf carts for certain purposes. For example, some golf carts are equipped with a clipboard-like arrangement on the steering wheel for holding a score card and a pencil. Also, it is typical for carts to have a console which is adapted for holding golf balls and tees in convenient arrangements. Unfortunately, none of the known arrangements or accessories are convenient for securing looseleaf pages containing course information. Up until now, course information has been merely handed out to golfers as a pamphlet, which can become lost or misplaced.

Accordingly, it can be seen that a need yet remains for an apparatus for securing looseleaf pages to a golf cart so that course information can be displayed in a convenient manner for a golfer. It is to the provision of such a device that the present invention is primarily directed.

SUMMARY OF THE INVENTION

Briefly described, in preferred form the present invention comprises a device for mounting to a golf cart for supporting and displaying looseleaf pages, in particular for displaying course information. The invention comprises a device for mounting to a golf cart for supporting and displaying looseleaf pages, the golf cart being of the standard type having a steering column extending into the passenger compartment. The device includes a base for supporting the looseleaf pages in an orientation wherein the pages extend generally transversely of the steering column. A binder mechanism such as a ring-type binder is mounted to the base for retaining the looseleaf pages. The base includes at least one attachment element for securing the base to the steering column. Preferably, the attachment element includes a semi-cylindrical mounting bracket adapted to be mounted over and clamped to the steering column.

With this arrangement, course information can be displayed in a convenient manner, in a position readily visible to the golfer in the cart as he travels to the next hole. This arrangement helps to avoid losing the pages and keeps the pages within easy reach of the golfer. Likewise, the golfer can flip from page to page with relative ease and minimal distraction. By making the device easily mountable on the steering column of the cart, the carts can be sold separately by the manufacturer and then specific course information can be added by golf club personnel after receiving the carts.

Accordingly, it is an object of the present invention to provide a device for securing looseleaf pages to a golf cart which is simple to use, durable in construction, and economical in manufacture.

It is another object of the present invention to provide a device for securing looseleaf pages to a golf cart which allows good visibility of course information contained on the looseleaf pages while not obstructing driving visibility.

It is another object of the present invention to provide a device for securing looseleaf pages to a golf cart which can be easily mounted on and removed from the golf cart.

These and other objects, features, and advantages of the present invention will become apparent upon reading the following specification in conjunction with the accompanying drawing figures.

BRIEF DESCRIPTION OF THE DRAWING FIGURES

DETAILED DESCRIPTION

Figure 1:
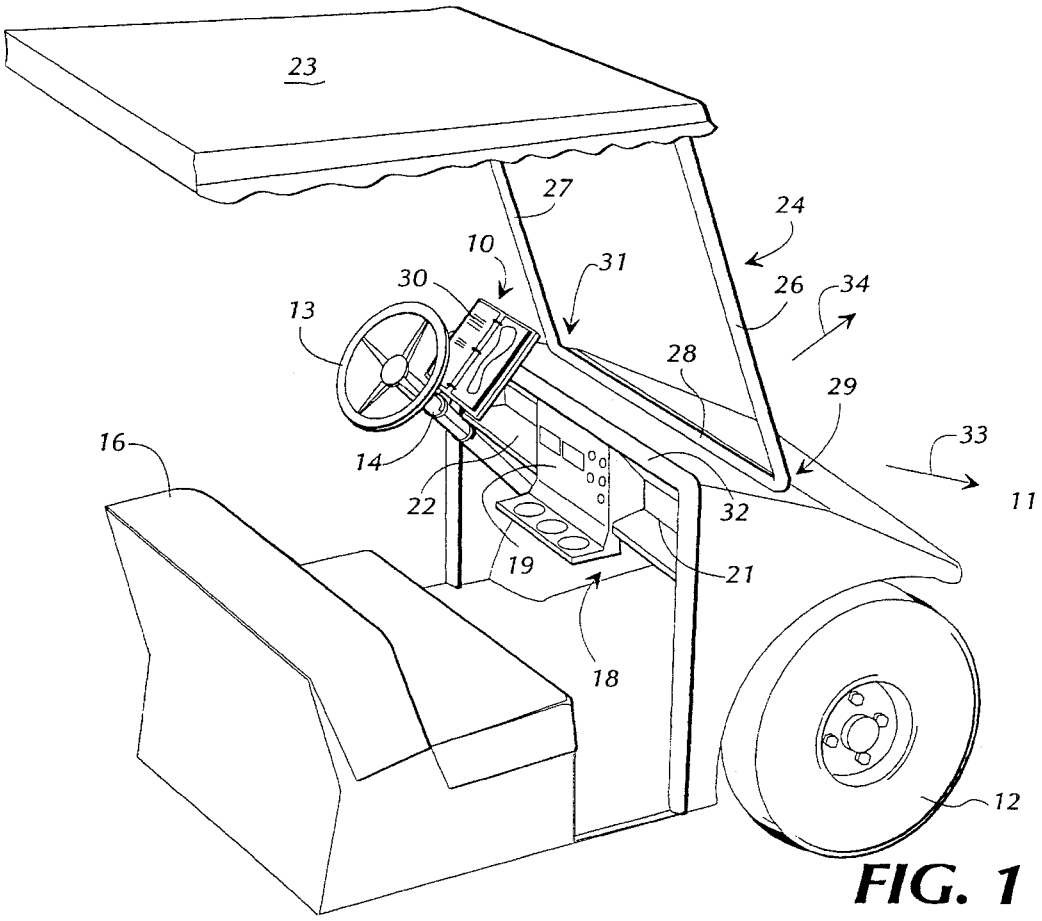
FIG. 1 is a perspective illustration of a portion of a golf cart showing a device according to a preferred form of the invention mounted thereto.

Referring now in detail to the drawing figures, wherein like reference numerals represent like parts throughout the several views, FIG. 1 shows a device 10 for securing looseleaf pages 30 to a golf can, the golf cart generally indicated at 11. The golf cart illustrated is of the commercially available type including front wheels, such as wheel 12, a steering wheel 13, a steering column 14, a padded seat 16, a cowl 17, and a dash indicated generally at 18.

The golf cart 11 depicted in FIG. 1 is a commercially available unit from E-Z-Go of Augusta, Ga. and typically includes a center console 19 situated in the dash 18 and defining compartments 21 and 22 on either side thereof The center console 19 is of the son described in the "Background of the Invention" portion of the present specification for holding golf balls and tees.

Many such golf cans include an upper canopy 23 to protect against sun and rain. The canopy 23 is supported over the golf cart by a support frame indicated at 24. Support frame 24 typically includes two upright stanchions 26, 27 connected by a lower beam 28 and an unshown upper beam. Typically, the support frame 24 is made up of a unitary piece of square tubing which has been formed by bending at corners 29, 31. The support frame 24 is secured to the cowl 17 by unshown bolts.

At a rear portion of the cowl 17, the cowl meets with the dash 18 along an upper edge. Typically, this edge is covered by a rubber strip 32. The cowl drops away from horizontal from this edge along direction 33. The device 10 holds the looseleaf pages 30 at an orientation 34 which is at an oblique angle relative to direction 33. That is to say that the cowl 17 lies in a plane containing direction arrow 33 and that the looseleaf pages 30 are held in a plane containing direction arrow 34, with these two planes being oriented at an oblique angle relative to each other. The advantage of this is that this tends to orient the pages 30 in a readable orientation for a golfer seated on the seat 16 of the cart 11, while minimizing obstruction of the golfer's field of vision as he drives cart 11.

Figure 2:
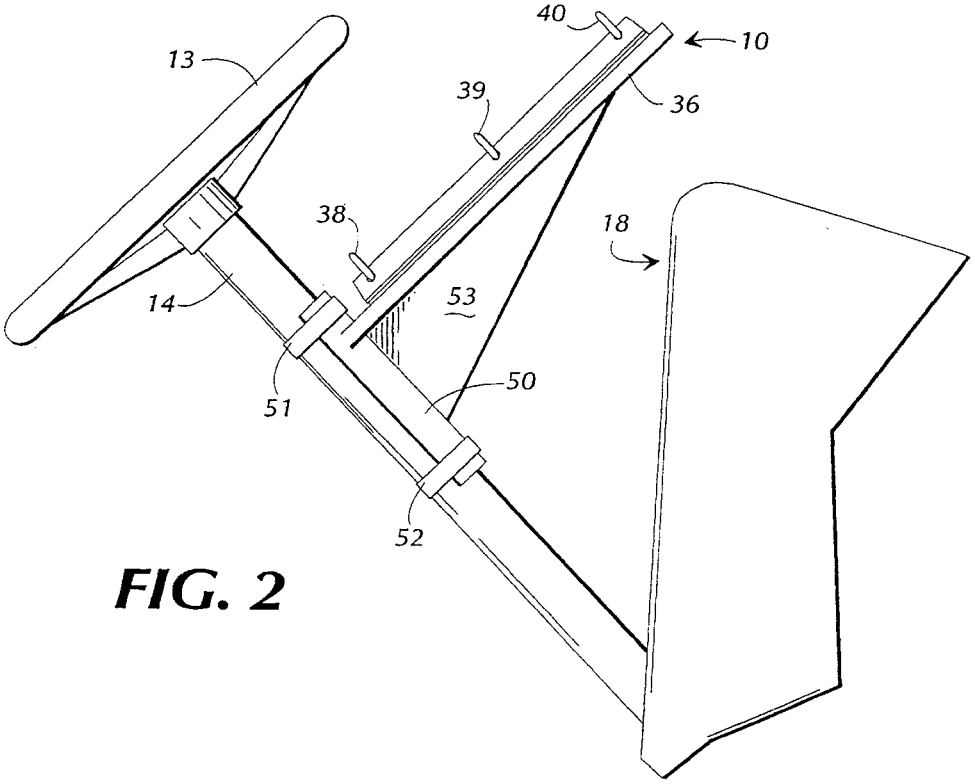
FIG. 2 is a schematic, side elevation view of the device of FIG. 1 shown mounted to a steering column portion of the golf cart.
Figure 3:
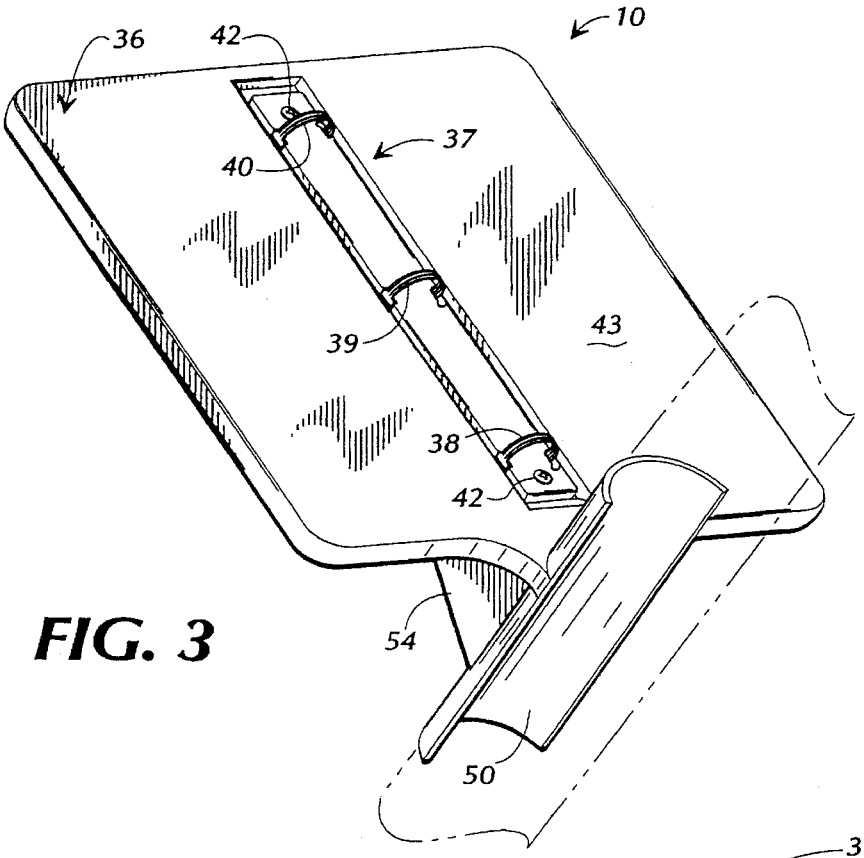
FIG. 3 is a schematic, perspective illustration of the device of FIG. 1.
Figure 4:
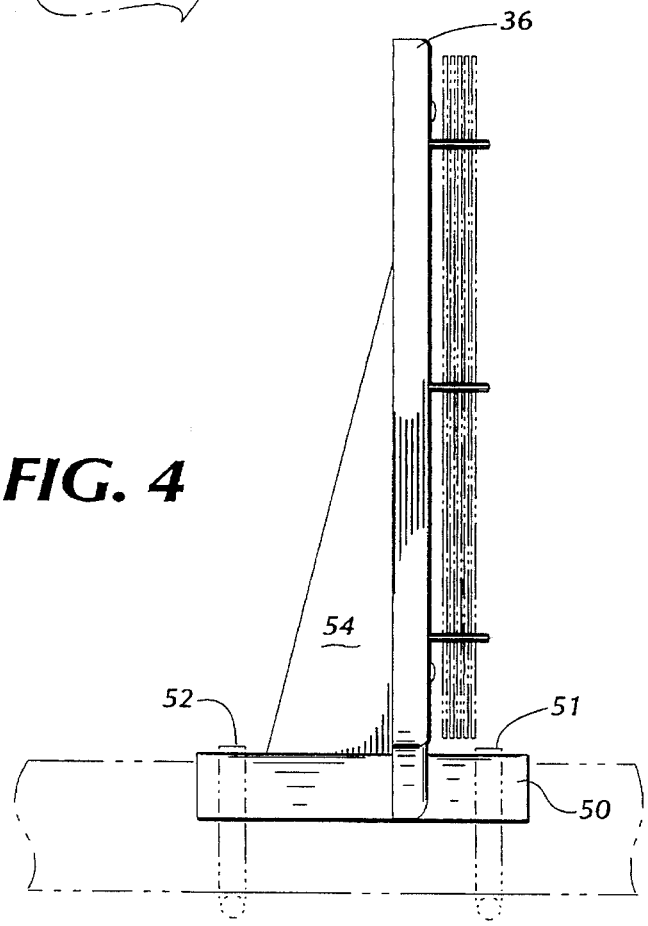
FIG. 4 is a side elevation view of the device of FIG. 1 showing a preferred form of an attachment element in greater detail.

Referring now to FIGS. 2 and 3, the preferred form of the invention is considered in more detail. Specifically, a device 10 is disclosed which can be mounted to a steering column 14 of the golf cart. In this first embodiment, device 10 includes a base 36 for supporting a binder mechanism indicated generally at 37. In the specific illustrative embodiment depicted in FIG. 3, the binder mechanism comprises a three-ring binder arrangement including binder rings 38, 39, and 40. The binder mechanism 37 is secured to the base 36 preferably by screws 42 having blunt tips, such that should the screws extend through the base 36, no sharp protrusions will be exposed. Alternatively, other conventional fastening means, such as rivets, adhesives, clips or welding may be utilized.

Figure 5:
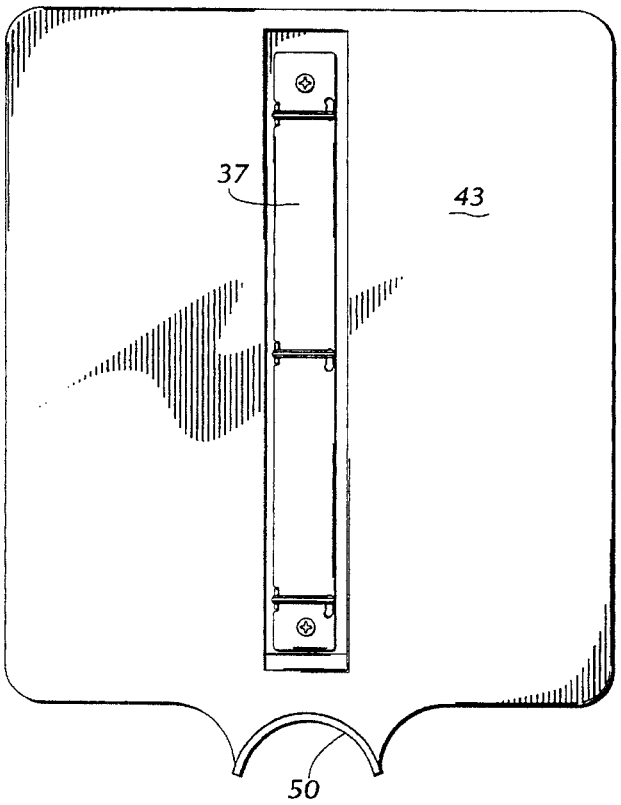
FIG. 5 is a plan view of the device of FIG. 1.
Figure 6:
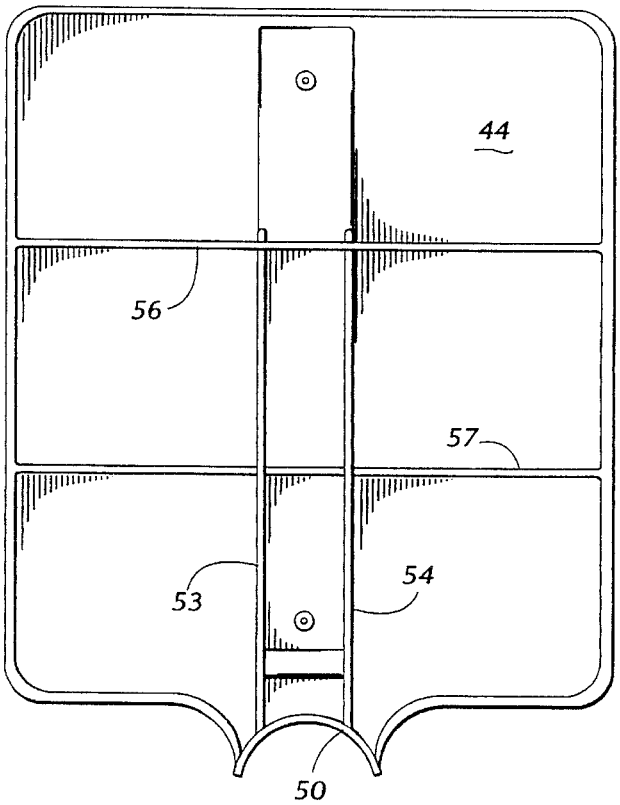
FIG. 6 is a bottom view of the device of FIG. 1.

The base portion 36 is generally planar as depicted in FIGS. 3, 5 and 6 in the form of a rectangular member having upper and lower surfaces 43 and 44, respectively. Base portion 36 is fabricated from a sturdy, weather resistant material, and preferably is made of ABS plastic. Binder mechanism 37 is attached to the upper surface 43 of base portion 36, as has been previously described.

An attachment means for securing the base 36 to the steering column 14 may be provided in the form of a semi-cylindrical mounting foot 50 which is shaped to fit in close registration around steering column 14, as shown by FIGS. 2 and 3. Mounting foot 50 is centrally attached to the lower end of base 36 such that part of the mounting foot extends above the base and part extends below the base. Mounting foot 50 is of sufficient length to provide adequate support for device 10, and may be secured to steering column 14 by clamps 51, 52, or by other suitable attachment means. Preferably, double-faced adhesive foam tape is placed between the mounting foot and the steering column 14 to improve the mechanical connection and to reduce shock loads on the device 10. Mounting foot 50 preferably is integrally formed with base 36 as by injection molding, however, alternate attachment means such as welding or adhesives may be used to secure mounting foot 50 to base 36. Mounting foot 50 is attached to base 36 in an orientation such that the cylindrical axis of mounting foot 50 is generally orthogonal to the plane containing base 36.

A pair of tapered flanges 53, 54 extend from the outer circumference of mounting foot 50 along lower surface 44 of base 36. Flanges 53, 54 provide additional stiffness to base 36 in order to prevent undue end-to-end deflection along the length of base 36 while the device is in use. Flanges 53, 54 are widest at their ends proximal mounting foot 50, and preferably taper to a narrow point at their distal ends.

Lower surface 44 of base 36, in its preferred form, further comprises ribs 56, 57 as shown by FIG. 6. Ribs 56, 57 extend crosswise along lower surface 44 to provide stiffness for base 36 and to prevent undue side-to-side deflection. By utilizing ribs 56, 57 and flanges 53, 54, base 36 may be fabricated of a relatively thin material, thus reducing weight and providing economy of manufacture, while still maintaining sufficient structural strength for the device's intended use. Of course, it may be possible to vary the number and arrangement of the flanges and ribs.

Preferably, to minimize manufacturing costs and to enhance the weather-resistance of the device 10, the base 36, the mounting foot 50, the flanges 53, 54, and the ribs 56, 57 are injection molded of a suitable plastic material such as ABS. Of course, other constructions are possible.

Figure 7:
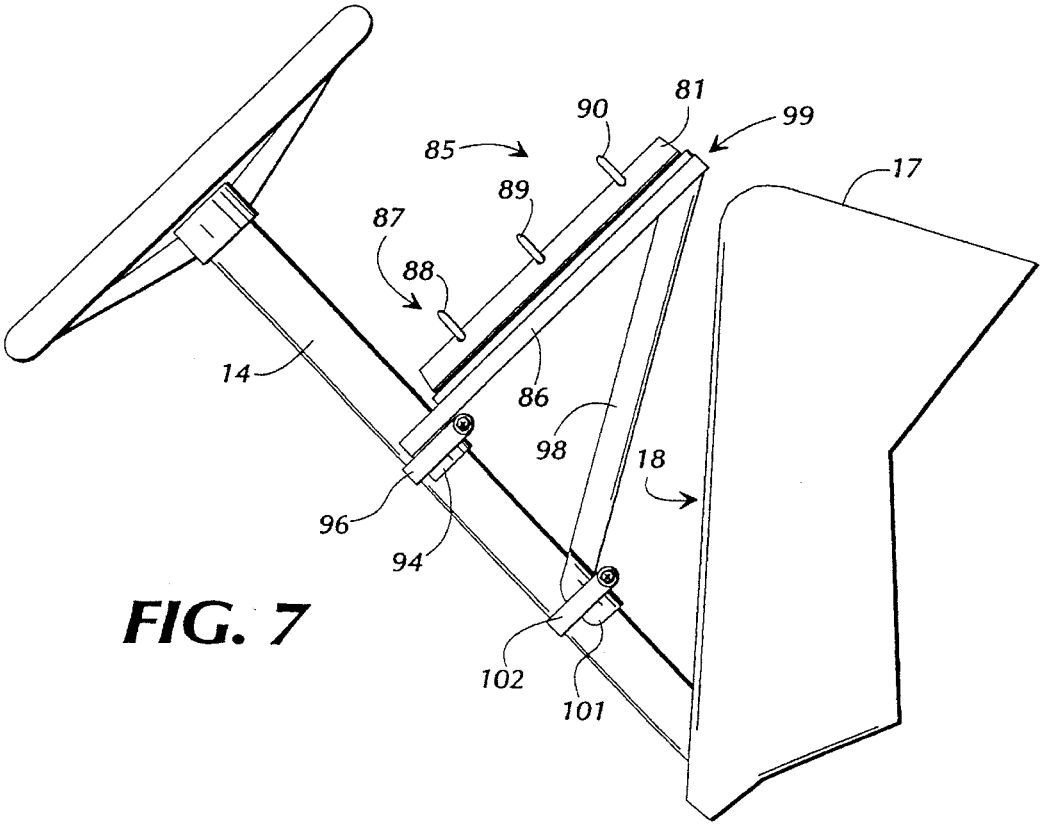
FIG. 7 is a schematic, side elevation view of the device according to a second preferred form of the invention.
Figure 8:
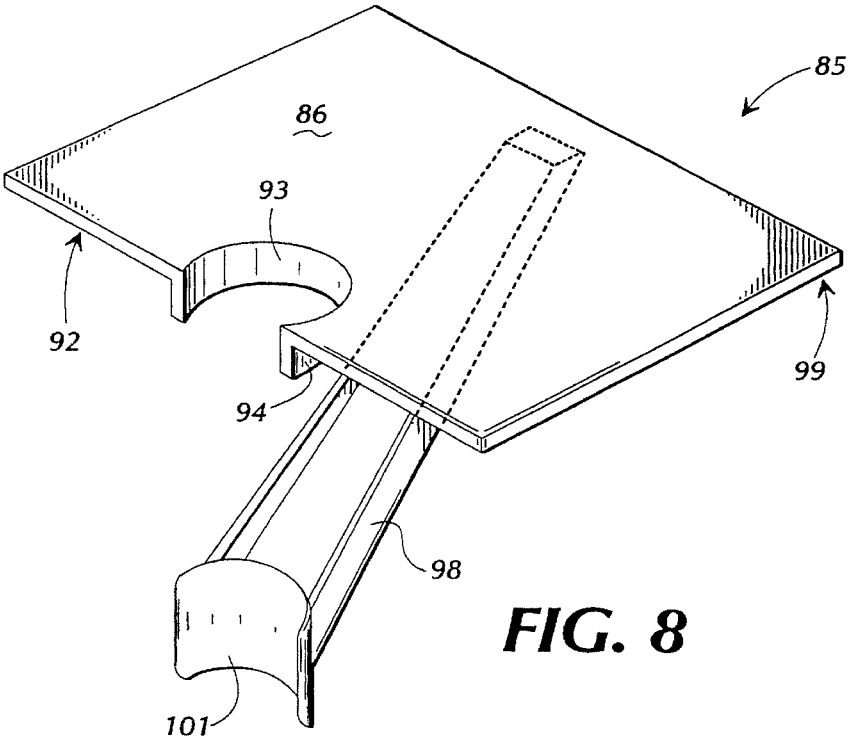
FIG. 8 is a schematic, perspective illustration of the device of FIG. 7.

Referring now to FIGS. 7 and 8, a second preferred form of the invention is shown. Specifically, a device 85 is disclosed which can be mounted to a steering column 14 of the golf cart. In this embodiment, device 85 includes a base 86 for supporting a binder mechanism indicated generally at 87. In the specific illustrative embodiment depicted in FIG. 5, the binder mechanism comprises a three-ring binder arrangement including binder rings 88, 89, and 90. The binder mechanism 87 is secured to the base 85 by conventional means, such as by unshown rivets.

The base portion 86 is generally planar as depicted in FIGS. 7 and 8 in the form of a rectangular member. Along one edge 92 of the planar base 86, a cut-out or opening is defined by a semi-cylindrical wall portion 93. The semi-cylindrical wall portion 93 thus defines a semi-circular opening or aperture in the base 86. At this opening, a lip extends below the lower surface of the base 86 to define a mounting foot 94. The mounting foot 94 is semi-cylindrical in shape and is adapted to be slipped over the steering column 14 so that the steering column is received within the opening defined by the semi-cylindrical wall 93. The semi-cylindrical mounting foot 94 can then be secured in place about the steering column 14 with the use of a clamp, such as hose clamp 96. The opening defined by the semi-cylindrical wall 93 together with the mounting foot 94 collectively operate as an attachment means for securing the base to the steering column.

A second attachment means for securing the base to the steering column is provided in the form of a strut 98. The strut 98 is elongated and extends from an edge portion 99 of the base 86 to the steering column. The strut 98 can be integrally formed with the base 86 or can be secured thereto by any suitable means such as fasteners, welding, or adhesives. The strut 98 is positioned at an inclined angle relative to the base 86 so as to maintain the base 86 at a generally perpendicular orientation with respect to the steering column 14. In turn, this supports the pages 81 secured by the binder mechanism 85 in an orientation extending generally transversely of the steering column 14, and preferably in an orientation which is perpendicular to the steering column 14. The strut 98 also includes a semi-cylindrical mounting foot 101 for placement against steering column 14 for mounting the strut to the steering column. With the mounting foot 101 placed against the steering column 14, the mounting foot can be secured in place by a second hose clamp 102.

Preferably, to minimize manufacturing costs and to enhance the weather-resistance of the device 85, the base 86 and the strut 98 are injection molded of a suitable plastic material. Of course, other constructions are possible.

With the arrangements disclosed herein according to the two preferred embodiments, it can be seen that the looseleaf pages can be mounted in a position and orientation which allows good visibility of course information contained on the looseleaf pages. For example, base 36 is attached to mounting foot 50 in a generally orthogonal orientation, such that base 36 extends from steering column 14 transversely upwards between steering wheel 13 and dash 18. Mounting foot 50 is positioned on steering column 14 such that adequate clearance is provided between steering wheel 13 and device 10 so as not to interfere with steering the cart. Additionally, device 10 should be positioned where it will not obstruct the driver's field of vision during operation.

The arrangements according to the preferred embodiments disclosed herein are simple to use, durable in their construction, and are economical in manufacture. Also, these devices are easily mounted on and removed from the golf cart. These arrangements help to keep the pages within the easy reach of the golfer and, since they are easily inserted and removed, can be added by the golf club personnel after purchasing the golf cart. Likewise, the present invention allows golf club personnel to change the information on the pages as the need arises, such as for tournaments or other special events.

While the invention has been disclosed in preferred forms only, it will be readily apparent to those skilled in the art that many modifications, additions, and deletions may be made therein. For example, it will be apparent to those skilled in the art that the present invention has direct application to golf carts made by other manufacturers, such as Club Car (of Augusta, Ga.) and Yamaha. These and other additions, deletions, and modifications nevertheless fall within the scope and spirit of the invention as defined by the appended claims.

What is claimed is:

1. A device for mounting to a golf cart for supporting and displaying looseleaf pages, the golf cart of the type having a steering column, said device comprising:

a base for supporting looseleaf pages in an orientation wherein the pages extend generally transversely of the steering column;

a ring binder mechanism fixedly mounted to said base for retaining looseleaf pages; looseleaf pages retained in said ring binder mechanism; and attachment means fixedly connected to said base for securing said base to the steering column, said attachment means comprising a semi-cylindrical mounting foot adapted to be mounted over and attached to the steering column.

2. A device as claimed in claim 1 wherein said attachment means comprises two semi-cylindrical attachment feet adapted to be mounted over and attached to the steering column.

3. A device as claimed in claim 1 further comprising at least one structural flange attached to said base and to said attachment means for supporting said base in an upright position relative to the steering column.

4. A device as claimed in claim 1 wherein said attachment means and said base are arranged to orient said base substantially perpendicular to the steering column with said device mounted to the steering column.

5. A device as claimed in claim 1 wherein said mounting foot extends above and below said base.

6. A device as claimed in claim 1 wherein said semi-cylindrical mounting foot is adjacent a first end of said base for securing said base to the steering column, further comprising:

a second mounting foot for securing said base to the steering column, said second mounting foot being mounted to said base at a position generally opposite said first end of said base.

7. A device as claimed in claim 6 wherein said base defines a semicircular opening for receiving the steering column therein.

8. A device as claimed in claim 6 further comprising a strut extending from said base to said second mounting foot.

* * * * *